US010660453B2

(12) United States Patent
Brandner et al.

(10) Patent No.: US 10,660,453 B2
(45) **Date of Patent: *May 26, 2020**

(54) WEARABLE CHILD CARRIERS AND METHODS OF USE

(71) Applicants: Theresa Brandner, San Francisco, CA (US); Laura Petersen, Eagan, MN (US)

(72) Inventors: Theresa Brandner, San Francisco, CA (US); Laura Petersen, Eagan, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/036,150

(22) Filed: Jul. 16, 2018

(65) Prior Publication Data

US 2018/0317669 A1 Nov. 8, 2018

Related U.S. Application Data

(63) Continuation of application No. 14/927,384, filed on Oct. 29, 2015, now Pat. No. 10,021,993.

(60) Provisional application No. 62/069,829, filed on Oct. 29, 2014.

(51) Int. Cl.
*A47D 13/02* (2006.01)

(52) U.S. Cl.
CPC ..... *A47D 13/02* (2013.01)

(58) Field of Classification Search
CPC ..... A47D 13/02; A47D 13/025
USPC ..... D3/213, 214; 224/158–161, 156
See application file for complete search history.

(56) References Cited

U.S. PATENT DOCUMENTS 982,376 A 1/1911 MacFarlane
2,617,105 A * 11/1952 Backman ..... A41D 1/215 2/48
3,841,543 A 10/1974 Bolton
4,757,925 A 7/1988 Knittel
D332,865 S 2/1993 Wilmink
(Continued)

FOREIGN PATENT DOCUMENTS

JP 2000296033 A 10/2000
JP 2003111647 A 4/2003
(Continued)

OTHER PUBLICATIONS

Cleanlinesurf.com, article "12 Misconceptions About Wetsuits", published Jan. 10, 2013.

(Continued)

*Primary Examiner* — Scott T McNurlen
(74) *Attorney, Agent, or Firm* — Fortem IP LLP; Mary L. Fox

(57) ABSTRACT

Wearable child carriers and methods for use are disclosed. A representative device includes a sash configured to rest across a shoulder of the user and be positioned over the user's torso, and a cradle supported by the sash and configured to support and secure a child in a generally horizontal position against a frontside of the user's body. The cradle can include a head region supported by one end of the sash and configured to support and secure the sides and back of the child's head, a body region supported by another end of the sash and configured to support the child's torso and legs, and a flap extending from the body region and configured to wrap at least partially around the child's body and a portion of the body region.

20 Claims, 6 Drawing Sheets

(56) References Cited

U.S. PATENT DOCUMENTS

| | | | | |
|---|---|---|---|---|
| 5,243,724 | A | 9/1993 | Barnes | |
| 5,695,102 | A | 12/1997 | Jackson | |
| 6,105,188 | A | 8/2000 | Perez-Mesa et al. | |
| 10,021,993 | B2 | 7/2018 | Brandner et al. | |
| 2005/0258202 | A1 | 11/2005 | Stevens et al. | |
| 2006/0010600 | A1 | 1/2006 | Kendy | |
| 2007/0278264 | A1 | 12/2007 | Chesal et al. | |
| 2008/0054032 | A1* | 3/2008 | Jones | A45F 4/06 224/156 |
| 2010/0187268 | A1 | 7/2010 | Rosen et al. | |
| 2011/0226822 | A1 | 9/2011 | Higuchi | |
| 2012/0205406 | A1 | 8/2012 | Schachtner | |
| 2012/0234877 | A1 | 9/2012 | Hiniduma-Lokuge | |
| 2013/0299532 | A1* | 11/2013 | Jacobs | A47D 13/02 224/158 |
| 2014/0151414 | A1 | 6/2014 | Gutierrez | |

FOREIGN PATENT DOCUMENTS

| | | | |
|---|---|---|---|
| JP | 2006204315 | A | 8/2006 |
| JP | 2008245750 | A | 10/2008 |

OTHER PUBLICATIONS

Alibaba.com, "Top Quality SGS Stretch Neoprene Wetsuit Rubber Foam", visited Aug. 9, 2017.

* cited by examiner

WEARABLE CHILD CARRIERS AND METHODS OF USE

CROSS-REFERENCE TO RELATED APPLICATION(S)

The present application is a continuation application of U.S. patent application Ser. No. 14/927,384, filed Oct. 29, 2015, which claims the benefit of priority of U.S. Provisional Application No. 62/069,829, filed Oct. 29, 2014, titled "CHILD CARRIER," both of which are incorporated by reference herein in their entireties.

TECHNICAL FIELD

The present technology is directed generally to child carriers and methods of use, and in particular, to wearable child carriers and methods of use.

BACKGROUND

When a baby rides in a carrier worn by a caretaker, such as the baby's mother, the baby is in tune with the rhythm of the wearer's breathing, the sound of the wearer's heartbeat, and the wearer's movements, such as walking, bending, and reaching. This stimulation helps the baby regulate its own physical responses and exercise its vestibular system, which controls balance. Research has shown that premature babies who are touched and held gain weight faster and are healthier than babies who are not. Studies have also shown that the more babies are held, the less they cry and fuss. In indigenous cultures where baby-wearing is the norm, babies often cry for only a few minutes a day—in contrast to Western babies, who often cry for hours each day. Crying is exhausting for both the baby and the caretakers, and may cause long-term damage as the baby's developing brain is continually flooded with stress hormones.

Various wearable child carriers exist that allow the wearer to be hands-free and/or arms-free. Such existing carriers, however, have several drawbacks. For example, conventional "backpack-like" front carriers do not provide adequate support for the head and neck of the child, and thus are especially ill-suited for carrying infants and newborns. Moreover, such carriers force the child into an awkward, vertically-oriented position with their arms and legs extending laterally from the carrier and away from the wearer's body. Other conventional carriers can be difficult/complex to use, difficult to manufacture, and/or not comfortable to wear. Accordingly, there is a need for a new and improved child carrier that overcomes the problems and limitations associated with existing child carriers.

DETAILED DESCRIPTION

The present technology is directed generally to child carriers and methods of use, and in particular, to wearable child carriers and methods of use. In one embodiment of the present technology, the child carrier is a flexible sling configured to be positioned across a user's torso. The sling includes a sash configured to rest across a shoulder of the user and a cradle portion configured to support and secure the child in a generally horizontal position against a frontside of the user's body. In some embodiments, the cradle includes a head region configured to support and secure the sides and back of the child's head and a body region configured to support the child's torso and legs. The sling can further include a flap integral with and extending from the cradle and configured to wrap at least partially around the child's body to form a swaddle.

Figure 1:
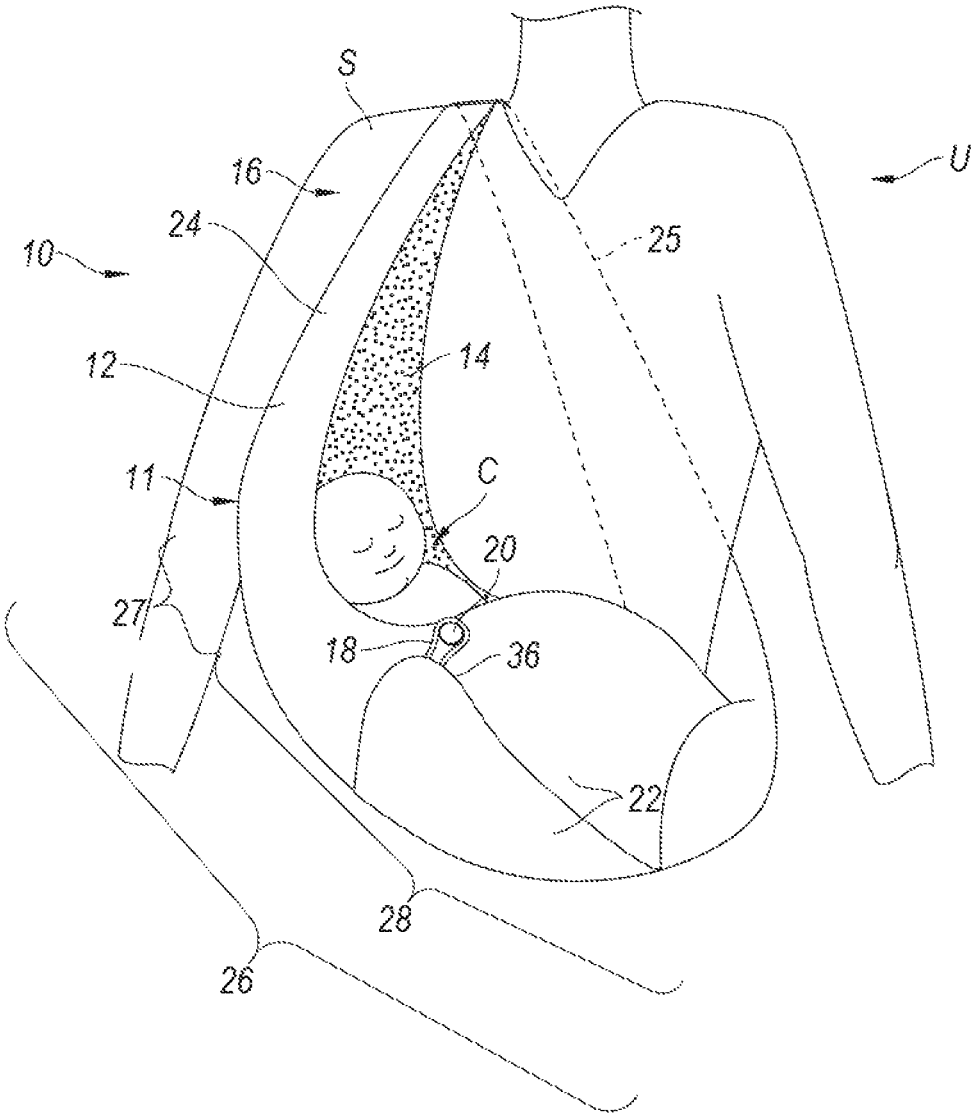
FIG. 1 is a front view of a carrier configured in accordance with the present technology. The carrier is shown positioned around the torso of a user and supporting a child.

FIG. 1 is a front view of one embodiment of a child carrier 10 (also referred to herein as the "carrier 10") configured in accordance with the present technology. The carrier 10 is shown supporting the weight of a child C and positioned around a torso of a user U. As used herein, a "child" refers to a human child that is two years of age or younger. In the embodiment shown in FIG. 1, the carrier 10 is a flexible sling 11 having an outer surface 12 and an inner surface 14. When the carrier 10 is worn by the user U (in the manner shown in FIG. 1), the inner surface 14 faces inwardly toward the child C. The carrier 10 further includes a sash 16 and a cradle 26 supported by the sash 16. The sash 16 is configured to rest across the user's shoulder S and positioned over a user's torso. The cradle 26 configured to (1) support and secure the child in a generally horizontal position, and (2) secure the child C against a front portion of the user's body. As used herein, the term "generally horizontal position" refers to a position of a child where the child is facing upwardly (e.g., away from the ground) and the child's torso is positioned at an angle of less than 45 degrees with respect to the ground.

The cradle 26 includes a head region 27 and a body region 28. The head region 27 is configured to support the back and sides of the child's head in a predetermined orientation. The body region 28 is configured to support the weight of the child C and secure the body of the child C within the carrier 10. In a representative embodiment, the cradle 26 also includes a flap 22 (only a portion visible in FIG. 1) having a free end portion 36 configured to be secured to another portion of the body region 28. The flap 22 can extend from and be integral with the body region 28, as described in greater detail below with reference to FIGS. 2A and 2B. The flap 22 is configured to wrap around the child's torso and legs and at least a portion of the body region 28 to secure the child C within the cradle 26.

In the embodiment shown in FIG. 1, the free end portion 36 of the flap 22 includes a first fastener 18 and the body region 28 includes a second fastener 20 configured to be releasably attached to the first fastener 18. In some embodiments, the first fastener 18 can be a loop (e.g., elastic or non-elastic) fixed to and extending away from the free end portion 36, and the second fastener 20 can be a button fixed to a portion of the body region 28. To secure the free end portion 36 of the flap 22 to the body region 28, the user loops the loop 18 around the button 20. It will be appreciated that the first and second fasteners 18, 20 are not limited to the above-described embodiment, and that the first and second fasteners 18, 20 can be any suitable attachment means, such as Velcro, a snap fastener, button hole and button, etc.

As shown in FIG. 1, the carrier 10 also includes a front connecting portion 24 and a rear connecting portion 25. The front connecting portion 24 extends between a front aspect of the sash 16 and the head region 27 of the cradle 26, and the rear connecting portion 25 extends between a rear aspect of the sash 16 and the body region 28 of the cradle 26. In the embodiment shown in FIG. 1, the front and rear connecting portions 24, 25 are integral with each other to form the sash 16. In other embodiments, one or both of the front and rear connecting portions 24, 25 can be separate components that are connected together to form the sash 16. Additionally, in some embodiments, the sash 16 can be a separate component configured to be releasably attached to the cradle 26. In any of the above embodiments, the carrier 10 can include one or more adjusting means (not shown) positioned at or near the front and/or rear connecting portion 24, 25 to adjust the length of the sash 16 and/or angular orientation of the cradle 26.

Figure 2A:
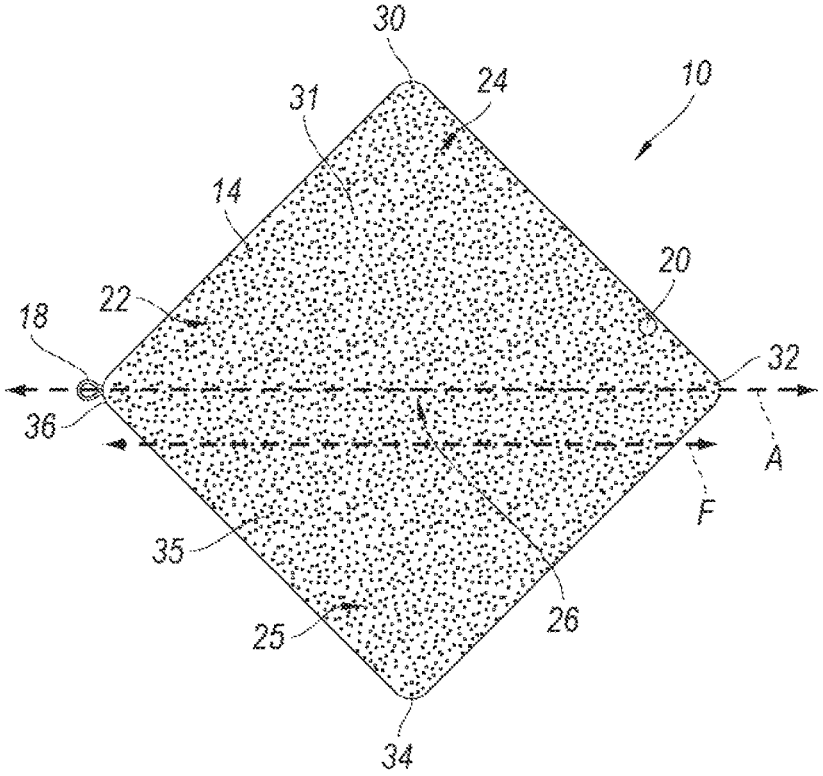
FIG. 2A is a top view of a carrier configured in accordance with the present technology, shown on a generally flat, level surface with an inner surface of the carrier facing up.
Figure 2B:
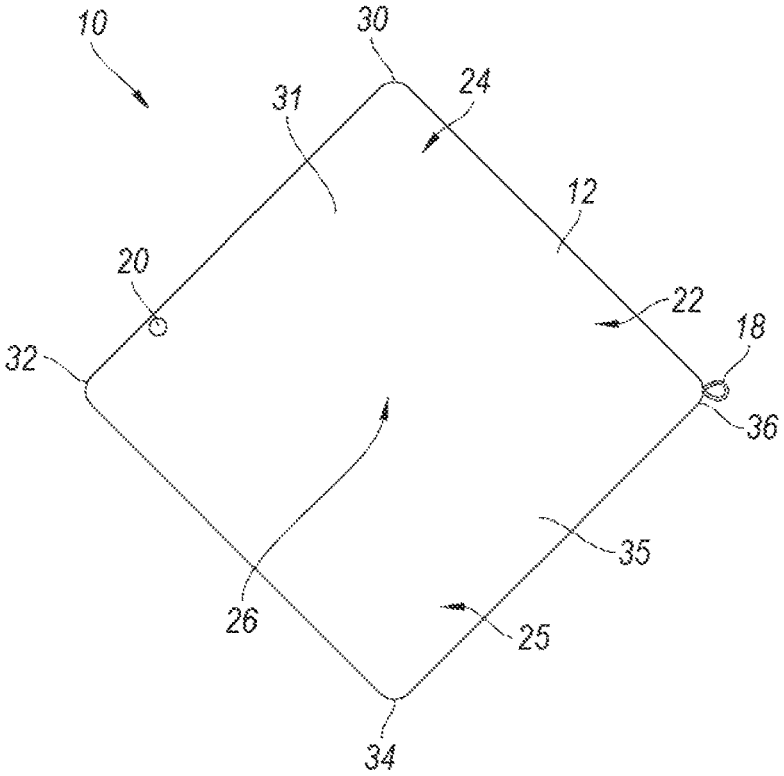
FIG. 2B is a top view of the carrier shown in FIG. 2A positioned on a generally flat, level surface with an outer surface of the carrier facing up.

The carrier 10 can be made from a stretchable, generally square-shaped, woven or knit fabric. For example, FIG. 2A is a top view of the carrier 10 in an open configuration positioned on a generally flat, level surface with the inner surface 14 of the carrier 10 face up (referred to herein as the "open, face-up configuration"). FIG. 2B is a top view of the carrier 10 in an open configuration positioned on a generally flat, level surface with the outer surface 12 of the carrier 10 face up (referred to herein as the "open, face-down configuration"). Referring to FIGS. 2A-2B together, the carrier 10 includes a front shoulder corner 30, an anchor corner 32, a rear shoulder corner 34, and the free end portion 36 of the flap 22. In the illustrated embodiment, the corners 30, 32, 34 and 36 are rounded. In other embodiments, one or more of the corners 30, 32, 34 and 36 can be square. In some embodiments, an apex of the front shoulder corner 30 can be positioned generally opposite an apex of the rear shoulder corner 34, and an apex of the anchor corner 32 can be positioned generally opposite an apex of the free end portion 36. In other embodiments, the corners 30, 32, 34 and 36 can have other suitable configurations. The straightline distance between the front and rear shoulder corners 30, 34 can be the same or different than the straight-line distance between the anchor corner 32 and the free end portion 36. Moreover, the respective distances along the periphery of the carrier 10 between apexes of adjacent corners can be the same or different. Additionally, although the carrier 10 is generally square-shaped in FIGS. 2A-2B, in other embodiments, the carrier 10 can include other suitable shapes (e.g., a circle, an oval, a polygon, an irregular shape, etc.).

As shown in FIGS. 2A-2B, the carrier 10 includes an axis A that extends across the carrier 10 through the anchor corner 32 and the free end portion 36, thus dividing the carrier 10 into a front portion 31 and a rear portion 35. The first fastener 18 is fixed at or near the free end portion 36 along the axis A. The second fastener 20 is positioned adjacent the anchor corner 32 but offset from the axis A such that, when the flap 22 is wrapped around the child and a portion of the body region 28, the second fastener 20 remains accessible for attachment to the first fastener 18. In the embodiment shown in FIGS. 2A-2B, the second fastener 20 is offset from the axis A closer to the front shoulder corner 30 (e.g., within the front portion 31) and positioned at or near the periphery of the carrier 10. In other embodiments, the second fastener 20 can be positioned offset from the axis A but within the rear portion 35 of the carrier 10, so long as the carrier 10 is subsequently folded along an axis within the front portion 31 of the carrier 10 (described in greater detail below with reference to FIG. 3).

Figure 3:
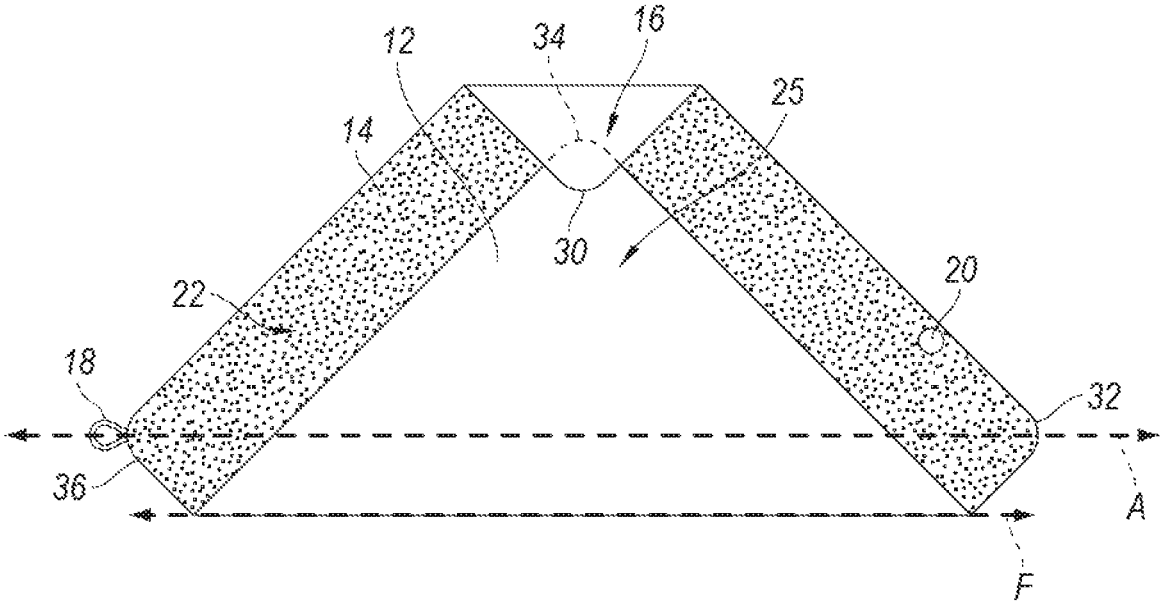
FIG. 3 is top view of the carrier shown in FIGS. 2A-2B positioned on a generally flat surface and in a sling configuration.

At some point before positioning the carrier 10 about a wearer, the carrier 10 can be placed in a sling configuration, as shown in FIG. 3. It is noted that the front and rear shoulder corners 30, 34 need not be attached before wrapping the child; in some embodiments the front and rear shoulder corners 30, 34 can be attached after wrapping the child. To position the carrier 10 in a sling configuration, a user can position the carrier 10 in the open, face-up configuration (FIG. 2A) and fold the rear shoulder corner 34 toward the front shoulder corner 30 (or vice versa) along a fold axis F (also shown in FIG. 2A). The fold axis F is generally parallel to and spaced apart from the axis A and positioned within the other of the front portion 31 or the rear portion 35 occupied by the second fastener 20. In some embodiments, the rear shoulder corner 34 and the front shoulder corner 30 can be permanently attached during manufacturing (e.g., via stitching and/or sewing means, adhesive, etc.) to form the sash 16. In other embodiments, the carrier 10 can include an attachment means (not shown) coupled to the rear shoulder corner 34 and/or the front shoulder corner 30 for permanently or releasably attaching the rear shoulder corner 34 and the front shoulder corner 30. In the embodiment shown in FIG. 3, at least a portion of the front shoulder corner 30 overlaps at least a portion of the rear shoulder corner 34 when the carrier 10 is in the sling configuration. In other embodiments, the rear shoulder corner 34 can overlap at least a portion of the front shoulder corner 30, and in yet other embodiments, the front and rear shoulder corners 30, 34 do not overlap when attached.

Figure 4A:
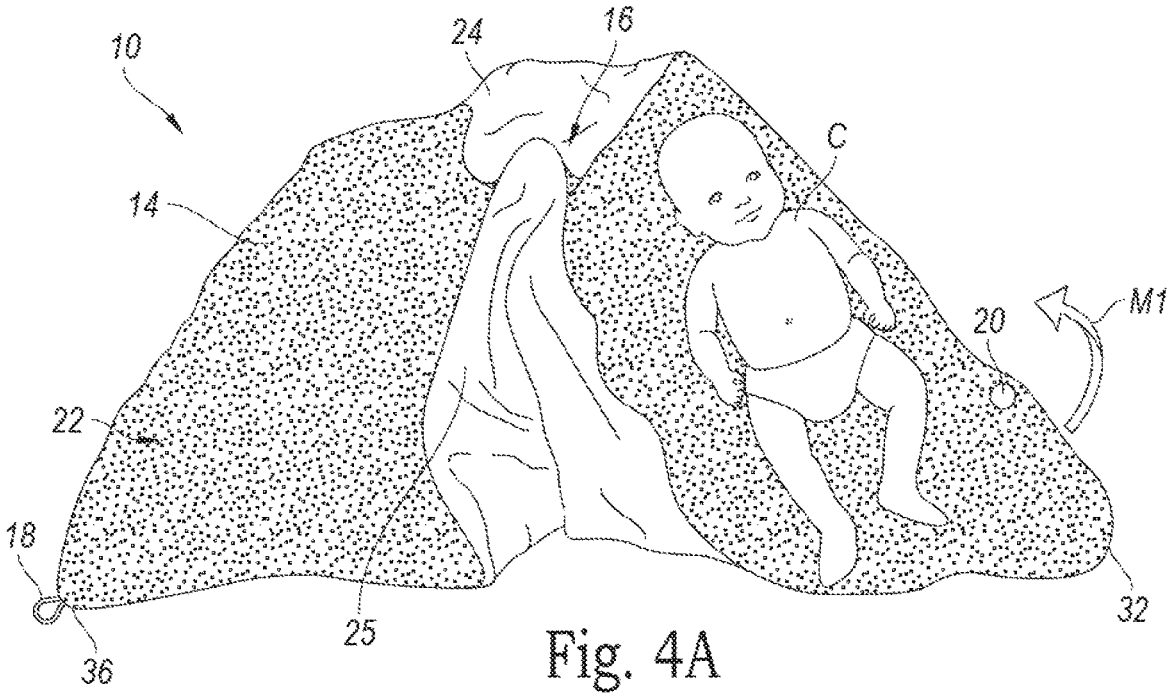
FIGS. 4A-4E illustrate a method for using a carrier configured in accordance with the present technology.
Figure 4B:
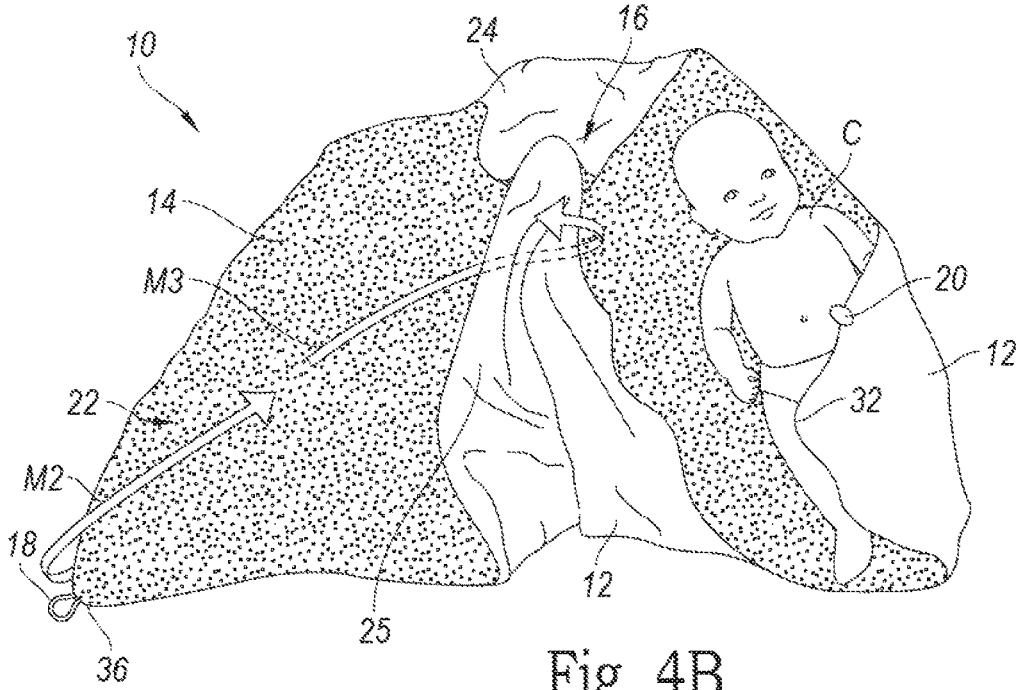
Figure 4C:
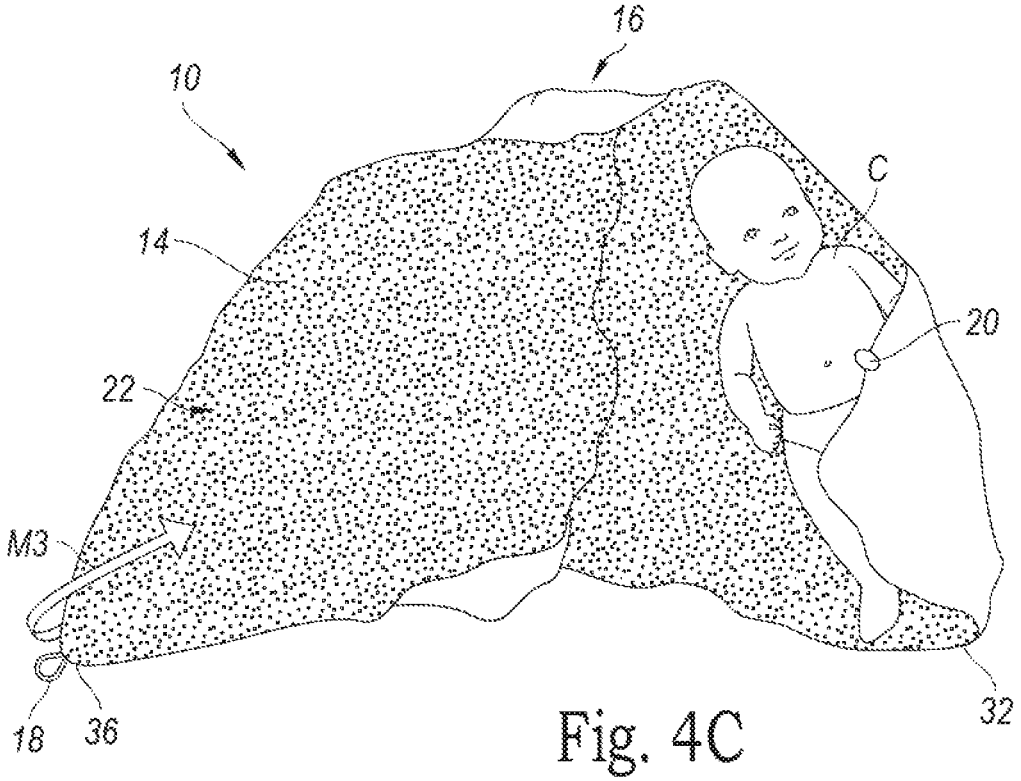
Figure 4D:
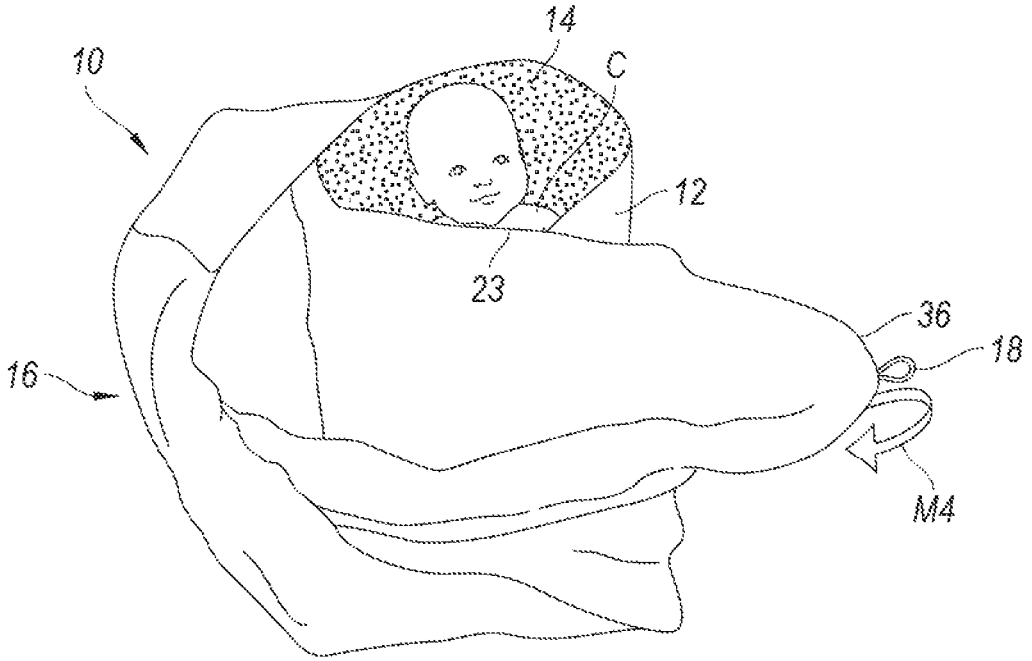
Figure 4E:
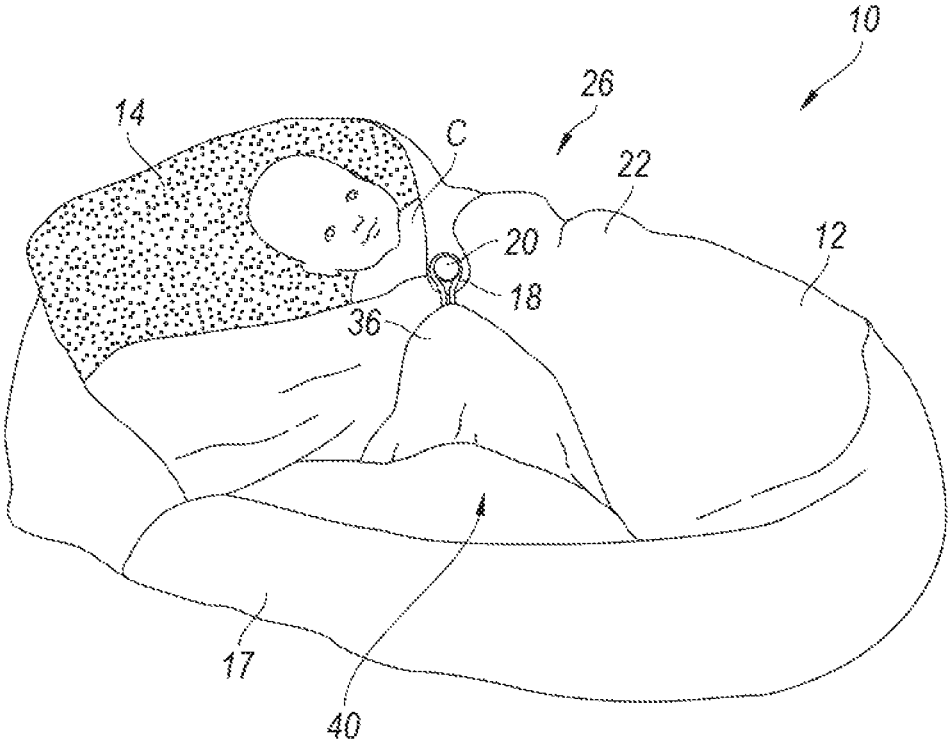

Before or after the carrier 10 is positioned in the sling configuration, the child C can be positioned on the inner surface 14 of the carrier 10 between the fold axis F and the front shoulder corner 30 of the carrier 10, as shown in FIG. 4A. The child C can be oriented such that the head of the child C is closer to the front shoulder corner 30. A portion of the body region 28 of the carrier 10 (including anchor corner 32) can be folded inwardly and upwardly (indicated by arrow M1), over at least a portion of the child's body such that the second fastener 20 is positioned at or near the child's bellybutton, as shown in FIG. 4B. The free end portion 36 can then be pulled under the sash 16 (indicated by arrows M2) and, optionally, laid open (e.g., inside surface 14 facing up) as shown in FIG. 4C. As shown in FIGS. 4C-4E, the user can then move the free end portion 36 and/or flap 22 across the child (indicated by arrow M3) and continue to wrap the free end portion 36 and/or flap 22 around the body of the child C (indicated by arrow M4) until the free end portion 36 is adjacent the second fastener 20. The flap 22 is sufficiently elastic such that the user can wrap the flap 22 around the child C to a desired level of tightness to form a swaddle.

With the free end portion 36 adjacent the second fastener 20, the first fastener 18 can be attached to the second fastener 20 to secure the flap 22 around the child C. In some embodiments, the second fastener 20 may be at least partially covered by the wrapped flap 22. In such embodiments, the user can temporarily displace a portion of the flap 22 to bring the second fastener 20 into view. The user can then raise the sash 16, place their right or left arm and head through an opening 40 between the cradle 26 and the sash 16, and rest the sash 16 on their shoulder (as shown in FIG. 1). In some embodiments, the position and/or width of the sash 16 can be adjusted based on the wearer's preference. If at any point while wearing the carrier 10 the wearer decides to put the child down, the wearer can, if desired, remove the carrier 10 from his or her person without having to unwrap the child. Likewise, should the user (e.g., a mother) desire to breastfeed the child while wearing the carrier 10, the user can conveniently adjust the position of the child relative to her person by sliding the sash 16 upwardly or downwardly, and use one or more portions of the carrier 10 for privacy.

From the foregoing, it will be appreciated that specific embodiments of the disclosed technology have been described herein for purposes of illustration, but that various modifications may be made without deviating from the technology. For example, although the methods described herein for using the carrier 10 include orienting the carrier 10 such that the child is positioned on the inner surface 14 the carrier 10, in some embodiments the carrier 10 is reversible such that a user has the option of orienting the carrier 10 such that the child C is positioned on the outer surface 12 the carrier 10, allowing the user to rest the sash 16 on the other shoulder. Moreover, the carrier 10 of the present technology can also be configured to support and/or carry a small animal, such a dog or cat. Certain aspects of the technology described in the context of particular embodiments may be combined or eliminated in other embodiments. Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

We claim:

1. A child carrier comprising:

a sash configured to rest across a shoulder of the user and be positioned over the user's torso; and a cradle supported by the sash, the cradle being configured to support and secure a child in a generally horizontal position against a frontside of the user's body, wherein the cradle includes:

a head region supported by one end of the sash and configured to support and secure the sides and back of the child's head, a body region supported by another end of the sash and configured to support the child's torso and legs, and a flap extending from the body region and configured to wrap at least partially around the child's body and a portion of the body region, wherein the sash and the cradle are made of the same piece of material such that the sash and cradle are integral with one another, wherein the device is configured to be transformed between first, second, and third configurations, and wherein the device further comprises:

a fastener fixed to the piece of material; and wherein, at least when the device is in the first configuration, the piece of material has first, second, third, and fourth corners arranged clockwise in order around the periphery of the piece of material, the piece of material includes a first axis extending through the second and the first axis in the direction of the third corner;

the fastener is fixed to the piece of material at the intersection of the first axis and the fourth corner;

wherein the device is transformable from the first configuration to the second configuration by folding the third corner towards the first corner along the second axis;

wherein, at least when the device is in the second configuration, the first corner of the piece of material is coupled to the third corner;

wherein the device is transformable between the second configuration and the third configuration by wrapping the fourth corner of the piece of material around the second corner of the piece of material.

2. The carrier of claim 1, wherein the flap includes a free end portion, and wherein the fastener is fixed to the free end portion.

3. The carrier of claim 1, wherein the fastener is a first fastener and the carrier further includes a second fastener fixed to a portion of the body region.

4. The carrier of claim 1, wherein the fastener is a first fastener and the flap includes a free end portion, wherein the first fastener is fixed to the free end portion, and wherein the carrier includes a second fastener fixed to a portion of the body region, wherein the first fastener is configured to be releasably attached to the second fastener.

5. The carrier of claim 1, wherein the carrier further includes a loop coupled to the flap.

6. The carrier of claim 1, wherein the fastener is coupled to the body region.

7. The carrier of claim 1, wherein the carrier further includes a loop coupled to the flap, and the fastener is coupled to the body region, wherein the loop is configured to releasably engage the fastener to secure the flap around the child.

8. The carrier of claim 1, wherein the sash has an adjustable width.

9. The carrier of claim 1, wherein the piece of material is a stretchable material.

10. The carrier of claim 1, wherein the piece of material is a woven or knitted fabric.

11. The carrier of claim 1, wherein the piece of material is square-shaped.

12. The carrier of claim 1, wherein the piece of material is a four-sided polygon.

13. The carrier of claim 1, wherein the fastener is a first fastener and the device further includes a second fastener fixed to the piece of material between the first and second corners, wherein the second fastener is offset from the first axis towards the first corner;

wherein, at least in the third configuration, the first fastener is coupled to the second fastener.

14. The carrier of claim 13, wherein the first, second, third, and fourth corners are rounded.

15. The carrier of claim 13, wherein, when the device is in the third configuration, the device is configured to be worn by a human wearer and secure a child to the frontside of the wearer.

16. The device-carrier of claim 13, wherein, when the device is in the third configuration, the device is configured to be positioned over the shoulder and across the torso of a wearer.

17. The carrier of claim 13, wherein, when the device is in the third configuration, the device is configured to secure a child in a generally horizontal position.

18. The carrier of claim 13, wherein, at least when the device is in the third configuration, the device is configured to be worn by a human wearer and secure a child to the wearer without the use of the wearer's hands or arms.

19. The carrier of claim 13, wherein, at least when the device is in the second configuration, the first and third corners of the piece of material are sewn together.

20. The carrier of claim 13, wherein, at least when the device is in the second configuration, at least a portion of the first corner overlaps at least a portion of the third corner.

* * * * *